United States Patent [19]

Kawagoshi et al.

[11] 3,947,340

[45] Mar. 30, 1976

[54] METHOD FOR FORMING γ-ALUMINA COATING ON REFRACTORY ARTICLE

[75] Inventors: Sakae Kawagoshi; Kunio Funabiki, both of Yokohama, Japan

[73] Assignee: Nissan Motor Company, Limited, Japan

[22] Filed: July 22, 1974

[21] Appl. No.: 490,664

[30] Foreign Application Priority Data

July 31, 1973 Japan ..... 48-85471

[52] U.S. Cl. ..... 204/181

[51] Int. Cl.[2] ..... C25D 13/02; C25D 13/20

[58] Field of Search ..... 204/181

[56] References Cited

UNITED STATES PATENTS

| | | | |
|---|---|---|---|
| 3,223,607 | 12/1965 | Millner et al. | 204/181 |
| 3,850,733 | 11/1974 | Szabo | 204/181 |

*Primary Examiner*—Howard S. Williams
*Attorney, Agent, or Firm*—Robert E. Burns; Emmanuel J. Lobato; Bruce L. Adams

[57] ABSTRACT

A refractory article is coated with a metal film by electroless plating. Particles of γ-alumina are deposited on the surface of the coated article by electrodeposition to prepare a catalyst carrier.

7 Claims, 2 Drawing Figures

METHOD FOR FORMING γ-ALUMINA COATING ON REFRACTORY ARTICLE

The present invention relates generally to a method for preparing a catalyst carrier for use in a catalytic converter in the exhaust pipe of an internal combustion engine and more particularly to a method of forming γ-alumina coating on the surface of a refractory article to form the catalyst carrier.

It is well known in the art that a catalyst, in which a catalytic metal is carried on the surface of a refractory carrier thereof, is usually used for conversion of noxious and harmful components of internal combustion engine exhaust gases or the like into harmless ones. An improvement in the efficiency of the conversion has now been accomplished by increasing the surface area of the catalyst carrier so as to carry a larger amount of catalytic metal thereon. For increasing the surface area of the catalyst carrier, the carrier made of a refractory material is usually coated with a film of γ-alumina which provides a rugged and porous surface thereon. Such catalyst carrier is usually prepared, for instance, by dipping a refractory article into an aqueous suspension, dispersion or slurry of the γ-alumina itself, drying and calcining.

However, in this prior art method, difficulties have been encountered in that a uniform film of γ-alumina cannot been formed on the surface of the article, and the resultant γ-alumina film is not reproducible on repeated runs. Accordingly, it has been impossible to form a uniform required amount or thickness of γ-alumina on the surface of the refractory article.

It is therefore an object of the present invention to provide a method for preparing an improved catalyst carrier which method overcomes the difficulties in the prior art method.

It is another object of the present invention to provide an improved method for forming γ-alumina coating on the surface of a refractory article to form the catalyst carrier.

It is still another object of the present invention to provide a method for forming a required amount or thickness of γ-alumina coating on the surface of the refractory article with reproducibility thereof.

Figure 1:
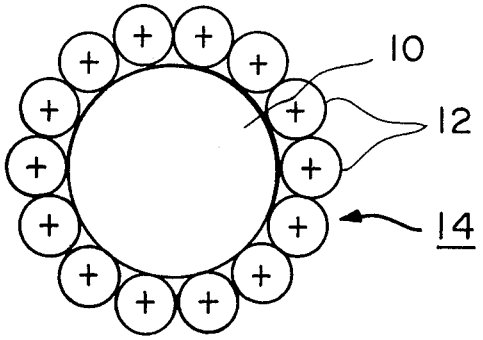
Figure 2:
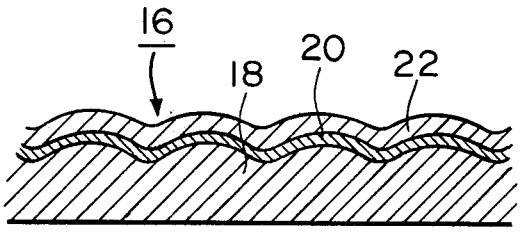

These and other objects and advantages of the present invention will become apparent from the following description when taken in conjunction with the accompanying drawings, in which:

FIG. 1 illustrates the state in that a γ-alumina particle is covered with colloidal alumina particles; and FIG. 2 is a cross-sectional view illustrating a catalyst carrier structure prepared by a method according to the present invention.

In accordance with the method of the present invention, a refractory article is firstly coated with a metal film by means of electroless plating for providing electrical conductivity on the surface thereof. Particles of γ-alumina are thereafter deposited on the surface of the article coated with the metal film by means of electrodeposition.

The method of the present invention is fully described hereinafter. The refractory article used in the method is made of a chemically substantially inert, rigid, solid material capable of maintaining its shape and strength at high temperature, for instance up to 1100°C. The material includes a variety of metal oxides and ceramic materials, for instance cordierite. The refractory article may be of unitary or monolithic type, or in granule, pellet, or tablet forms. The article is now commercially available in the open market.

Onto the external surface of the refractory article, a film of such metal as nickel, chromium, cobalt, or copper is firstly coated by means of electroless plating techniques. The electroless plating techniques are well known in the art. The coated carrier is thereafter immersed in an aqueous suspension containing colloidal alumina particles and γ-alumina particles for electrodeposition in that the refractory article coated with the metal film serves as the cathode.

As is shown in FIG. 1, in the aqueous suspension, a γ-alumina particle 10 is covered with colloidal alumina particles 12 carrying positive charges to form a particle aggregate 14 carrying a positive charge as a whole. Accordingly, during the electrodeposition, the particle aggregates are deposited on the surface of the coated article as the cathode to form a mixed film of the γ-alumina particles and the colloidal alumina particles.

In FIG. 2, the catalyst carrier structure 16 prepared by the method according to the present invention is shown with the refractory article 18 made of a metal oxide such as cordierite, the metal film 20 coated by the electroless plating, and the mixed film 22 of the alumina colloidal particles and the γ-alumina particles, respectively designated.

The following example is given for the purpose of further describing the method of the present invention and to indicate the benefits afforded through the utilization thereof.

EXAMPLE

A refractory article made of ceramic material was immersed in an aqueous solution containing 0.2g/*l* of palladium chloride for 30 seconds. The thus treated article was thereafter immersed in an aqueous solution containing 30g/*l* of nickel chloride, 10g/*l* of sodium hypophosphite, and 100g/l of sodium citrate at 90°C for 5 minutes for electroless nickel plating on the surface thereof. The thus nickel coated article was immersed in an aqueous suspension containing 63 parts by weight of water, 27 parts by weight of colloidal alumina particles, and 30 parts by weight of γ-alumina particles for electrodeposition. In this electrodeposition, the time of treatment, and the applied voltage and amperes were varied to determine the weight variation of deposit containing colloidal alumina particles and γ-alumina particles on the surface of the nickel coated carrier as the cathode.

The deposit weight under the varying conditions are shown in the Table below.

| Time of treatment, sec. | Voltage and ampere | Deposit weight, grams | |
|---|---|---|---|
| | | 100 V 1 A | 150 V 1.5 A |
| 15 | | 2.3 | 3.1 |
| 30 | | 4.1 | 5.8 |
| 60 | | 8.4 | 12.5 |
| 120 | | 15.7 | 23.7 |

* Surface area of refractory article before electrodeposition: 5 $dm^2$

It is noted that the deposit weight obtained by ten repeated electrodepositions under the same conditions were reproduced within ±0.2g. This fact shows that the method according to the present invention is considerably reproducible.

It is understood that a required thickness of γ-alumina coating can be easily formed on the surface of the refractory article. In addition the resultant γ-alumina coating is uniform and has larger bonding strength than one according to the prior art method.

For the purpose of practical use as a catalyst to convert noxious and harmful components in the automotive exhaust gases into harmless ones, the γ-alumina coated refractory article will be impregnated with a catalytic metal capable of oxidizing carbon monoxide and hydrocarbons and reducing nitrogen oxides, for instance platinum, ruthenium, rhodium, and palladium. By this impregnation, a considerably uniform coating of the catalytic metal will be obtained due to the uniform basis of the γ-alumina coating over the catalyst carrier surface.

What is claimed is:

1. A method for forming a γ-alumina coating on the surface of a refractory article, said method comprising the steps of:

coating a metal film onto the surface of the refractory article by means of electroless plating for providing conductivity on the surface of said refractory article;

immersing the coated refractory article in a suspension containing γ-alumina particles and colloidal alumina particles, said γ-alumina particles being covered with said colloidal alumina particles to form particle aggregates carrying positive charge;

making said so-coated article the cathode in an electrodeposition cell and depositing a layer of γ-alumina particles and colloidal alumina particles on the surface of said metal film on said refractory article, by the application of an electrodeposition potential.

2. A method according to claim 1, in which said electroless plating is carried out by immersing said refractory article in an aqueous solution containing a compound of the metal at a predetermined temperature for a predetermined time after immersing said refractory article in an aqueous solution of palladium chloride.

3. A method according to claim 1, in which said electrodeposition is carried out by using said refractory article, coated with said metal film, as the cathode in an aqueous suspension containing γ-alumina particles and colloidal alumina particles.

4. A method according to claim 1, in which said refractory article includes a metal oxide.

5. A method according to claim 4, in which said metal oxide includes a ceramic material.

6. A method according to claim 5, in which said ceramic material includes cordierite.

7. A method according to claim 1, in which said metal of said film is a metal selected from the group consisting of nickel, chromium, cobalt, and copper.

* * * * *